US005937560A

United States Patent [19]

Beltz

[11] Patent Number: 5,937,560

[45] Date of Patent: Aug. 17, 1999

[54] ADJUSTABLE FIRE ARM SUPPORT

[75] Inventor: Kasey Dallas Beltz, Wichita, Kans.

[73] Assignee: B-5, Inc., Wichita, Kans.

[21] Appl. No.: 08/982,546

[22] Filed: Dec. 2, 1997

[51] Int. Cl.[6] ..... F41A 23/06

[52] U.S. Cl. ..... 42/94

[58] Field of Search ..... 42/94

[56] References Cited

U.S. PATENT DOCUMENTS

| | | | |
|---|---|---|---|
| 2,844,905 | 7/1958 | Musser et al. | 42/94 |
| 2,991,579 | 7/1961 | Lies | 42/94 |
| 3,012,350 | 12/1961 | Wold | 42/94 |
| 4,351,224 | 9/1982 | Curtis | 42/94 |
| 4,393,614 | 7/1983 | Pickett | 42/94 |
| 4,625,620 | 12/1986 | Harris | 42/94 |
| 4,987,694 | 1/1991 | Lombardo | 42/94 |
| 5,029,407 | 7/1991 | Kirkpatrick | 42/94 |
| 5,081,782 | 1/1992 | Wright | 42/94 |
| 5,194,678 | 3/1993 | Kramer | 42/94 |
| 5,345,706 | 9/1994 | Brown | 42/94 |
| 5,347,740 | 9/1994 | Rather et al. | 42/94 |

*Primary Examiner*—Charles T. Jordan
*Assistant Examiner*—Denise J Buckley
*Attorney, Agent, or Firm*—Robert O. Blinn

[57] ABSTRACT

The adjustable firearm support of present invention works in combination with a firearm stock having a sling stud mounted to its underside near its butt end. This firearm support includes four basic parts; namely, a support rod, a base member, a position sleeve and a support leg. The support rod has a pivotally mounted clasp for engaging the sling stud and a threaded outer surface for receiving the position sleeve and the support leg which both have threaded central bores. The base member has an upper cradle surface for fitting up against the firearm stock, a central bore for receiving the support rod and a side slot for allowing the support rod to pivot in relation to its clasp into a horizontal folded position. An assembled adjustable firearm support can be attached to a firearm stock by engaging the clasp with the sling stud and tightening the position sleeve up against base member. When the support leg of the attached adjustable firearm support is placed on a stable horizontal surface, the support leg can be rotated about its threads to move it up and down in relation to the support rod to finely adjust the elevation of the firearm.

14 Claims, 4 Drawing Sheets

ADJUSTABLE FIRE ARM SUPPORT

BACKGROUND OF THE INVENTION

1. Field of the Invention

The present invention relates to firearm supports, and more particularly to an adjustable firearm support that attaches to a firearm stock and is manually operated to adjust firing elevation.

2. Description of the Prior Art

Fire arm and firearm supports of various designs have existed almost as long as firearms have existed. These supports have been used to provide a stable platform from which a mounted weapon may be fired with greater accuracy. One of these prior art supports, described in U.S. Pat. No. 5,345,706 issued to Brown, employs a clasp mechanism for latching to a firearm stock sling stud and a telescoping member to provide a highly portable, one leg firearm support for use by a firearm marksman in the standing position.

In order to shoot with great accuracy, a firearm marksman will shoot from the sitting position at a shooting bench or the prone position. When shooting from the sitting position at a shooting bench or the prone position, the firearm marksman, must precisely adjust the elevation of his firearm. When attempting to shoot from the sitting position at a shooting bench or the prone position with very great accuracy, a firearm marksman will often place a sand bag under the butt end of the firearm stock and manipulate that sand bag to obtain elevation. Sand bags, however are heavy and cumbersome and are an imprecise means of adjusting elevation. Further, marksman, in some situations, must carry their firearms and other equipment over significant distances. They need a compact device that can be easily attached to and carried with their firearm. What is needed then is a lightweight, compact and portable device that can be easily attached to a firearm and which can be used to precisely adjust elevation.

SUMMARY OF THE INVENTION

The adjustable firearm support of the present invention satisfies the aforementioned need by providing a very lightweight, compact and portable device which provides a means for precisely adjusting the elevation of a firearm.

The adjustable firearm support of the present invention works in combination with a firearm stock having a sling stud mounted to its underside adjacent to its butt end. The sling stud has a central hole for receiving hooks, clasps and the like. The adjustable firearm support includes four basic parts; namely, a support rod, a base member, a position sleeve, and a support leg. The support rod is externally threaded and has a clasp at one end for engaging the sling stud. The base member has a top cradle surface with sloped or curved sides that can conform to the surface of the firearm stock near the sling stud. The base member also has an axially symmetric lower surface and a central opening extending from the top cradle surface to the lower surface which allows it to fit over the support rod when the support rod is attached to the sling stud. The position sleeve has an axial bore which is threaded to accept the support rod and an axially symmetric upper surface shaped to rotate against the axially symmetric lower surface of the base member. The top end of the support leg is bored with a threaded bore for receiving the support rod and the bottom end of the support leg is fashioned for concentric rotation on a stable, horizontal surface.

The adjustable firearm support of the present invention is assembled as follows: The support leg is threaded on to the support rod. The position sleeve is then threaded onto the support rod. The base member is placed upon the support rod and then finally, the clasp is attached to the support rod. To use the adjustable firearm support, the clasp is attached to the sling stud near the butt end of the firearm stock. Then the position sleeve is tightened up against the base member. This pushes the base member firmly against the firearm stock to firmly mount the adjustable fire support to the firearm stock. Once the support leg is positioned on a stable, horizontal surface, it can be rotated about the support rod to precisely adjust the vertical position of the other parts of the adjustable firearm support and more importantly adjust the vertical position of the firearm stock to which they are attached.

The adjustable firearm support of the present invention also includes features that allow the support leg and support rod to be retracted up against the firearm stock for easy transport. These features include a pivot joint between the clasp and the remainder of the support rod and a slot in the lower end of the base member to provide clearance for the support rod as it rotates about the pivot joint into a retracted position. When in the retracted position, the position sleeve is tightened against the base member to lock the support rod, position sleeve and support leg into the retracted position. The base member has a second axial surface that receives the top surface of the position sleeve when, in the retracted position, it is tightened against the base member.

In addition to the above features for allowing the support rod, position sleeve and support leg to fold into a retracted position, a sling lug is also added to the base member. The base member sling lug is adapted to accept a sling strap end ring so that a sling strap can be attached to the firearm for easy transport.

Accordingly, the adjustable firearm support of the present invention attaches easily to a firearm and provides precise elevation adjustment. It is so compact that it goes almost unnoticed. Yet, when used with a sighting scope, a firearm marksman can aim and fire his firearm with extreme accuracy.

Other features and advantages of the present invention will be more readily apparent by reference to the following detailed description in connection with the accompanying drawings.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
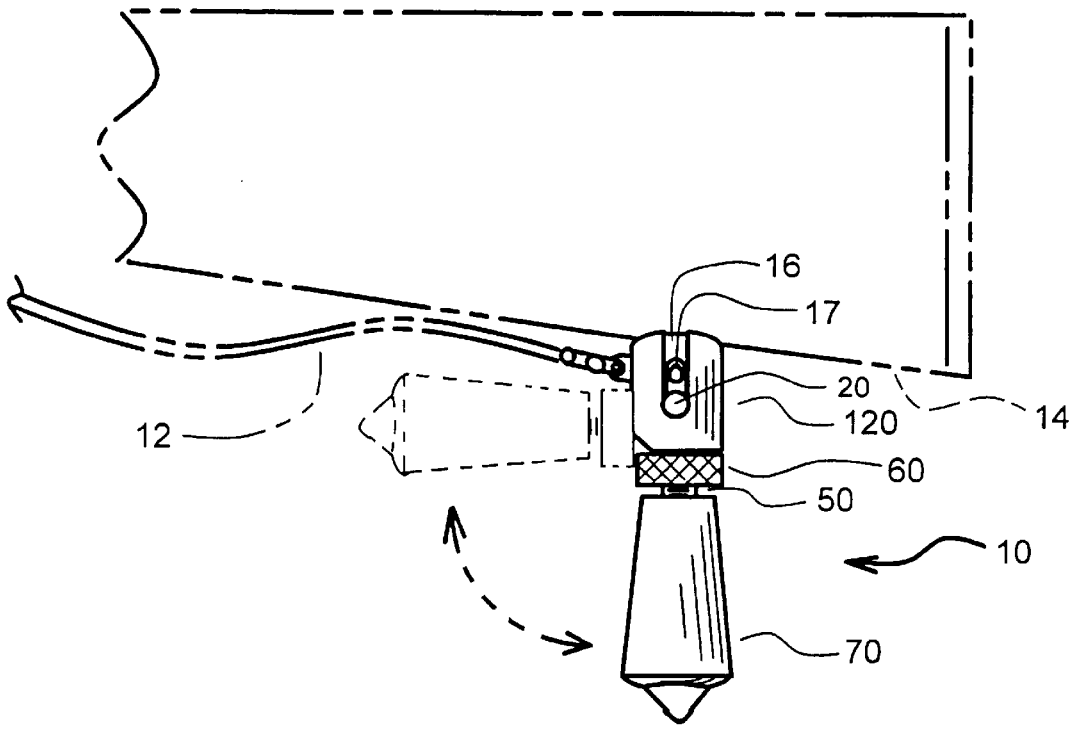
FIG. 1 is a side view of the adjustable firearm support of the present invention mounted to a firearm stock shown in reference.

Throughout the following detailed description, the same reference numerals refer to the same elements in all figures.

FIG. 1 is a side view of the adjustable firearm support 10 of the present invention shown in relation to a sling 12 and a firearm stock 14 which includes a sling stud 16 having a sling stud hole 17. As can be seen in FIG. 1, the adjustable firearm support 10, comprises a clasp 20, a support rod 50, a position sleeve 60, a support leg 70 and a base member 120.

Figure 2:
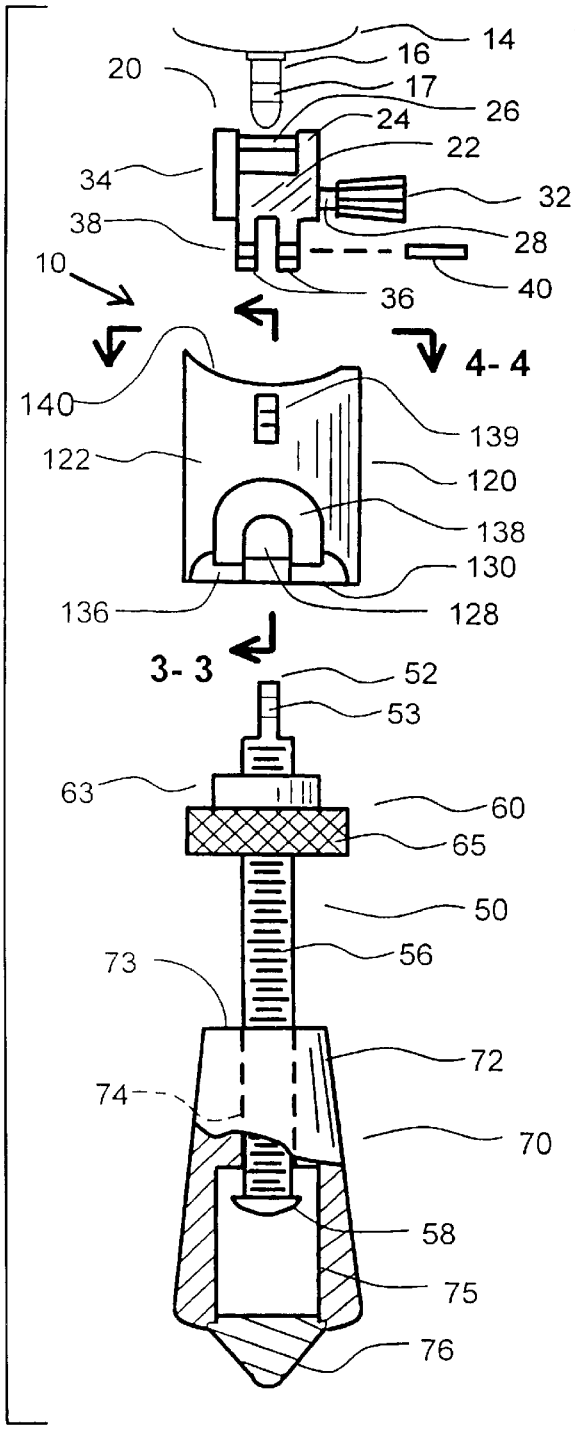
FIG. 2 is an exploded front view of the adjustable firearm support of the present invention.

FIG. 2, an exploded view of adjustable firearm support 10 of the present invention, shows clasp 20, support rod 50, position sleeve 60, support leg 70 and base member 120. In FIG. 2, clasp 20 is shown in relation to sling stud 16. Clasp 20 includes a clasp body 22, a stationary prong 24, a clasp pin 26, a slide pin 28, an external knob 32, a latch plate 34, a clevis 36 and a clevis pin 40. Stationary prong 24 projects upwardly from clasp body 22 and carries clasp pin 26. Slide pin 28 slides within clasp body 22 and is spring biased by an internal spring (not shown). Latch plate 34 is fixed at one end to slide pin 28 and has a hole (not shown) at its other end for receiving clasp pin 26. Knob 32 is attached at the other end of slide pin 28 and is used to manually adjust slide pin 28 and latch plate 34 which is attached to slide pin 28. The internal spring which biases slide pin 28 urges slide pin 28 so that latch plate 34 engages clasp pin 26 and so that knob 32 is pushed away from clasp body 22. Clasp pin 26 is adapted to engage sling stud hole 17 of sling stud 16 so that clasp 20 can be attached to sling stud 16. Clevis 36 depends from clasp body 22 and includes two co-axial clevis pin holes 38 adapted for receiving clevis pin 40. The components of clasp 20 should be fabricated from high strength steel capable of withstanding significant stresses.

As can be seen in FIG. 2, support rod 50 includes a lug portion 52, a threaded shaft 56 and a bolt head 58. Lug portion 52 has a hole 53 for receiving clevis pin 40 of clasp 20 so that clasp 20 can be attached to support rod 50. Threaded shaft 56 extends from lug portion 52 to bolt head 58. Support rod 50 can be fabricated from steel or brass or any material suitable for holding threaded surfaces. Support rod 50 could be easily fabricated from a simple carriage type bolt by machining a lug such as lug 52 into the end opposite the bolt head.

As can also be seen in FIG. 2, Position sleeve 60 includes a shoulder portion 63 and a knurled portion 65. Shoulder portion 63 defines an axially symmetric upper surface for position sleeve 60. Position sleeve 60 has an axial bore (not shown) which is threaded to receive the threaded shaft 56 of support rod 50. Position sleeve 60 can be fabricated from steel or brass or any material suitable for holding knurled and threaded surfaces.

Support leg 70 is also shown in FIG. 2. It includes a large handle body 72, a top surface 73, a threaded axial bore 74 and a rotation member 76. The large handle body 72 is designed to be easily manipulated by an operator. Threaded axial bore 74 is in normal relation to top surface 73 and is adapted to receive threaded portion 56 of support rod 50. Counter bore 75 extends from the bottom end of handle body 72 and meets threaded axial bore 74 near the center of handle body 72. Rotation member 76 closes off counter bore 75 and is adapted to turn on a stable surface. Support leg 70 can be made from a hard plastic capable of accepting internal threads or may have a metal insert for providing threaded axial bore 74. In the preferred embodiment, support rod 50 is threaded into support leg 70 before rotation member 76 is permanently fixed in place by an adhesive thereby creating a permanent assembly.

Figure 9:
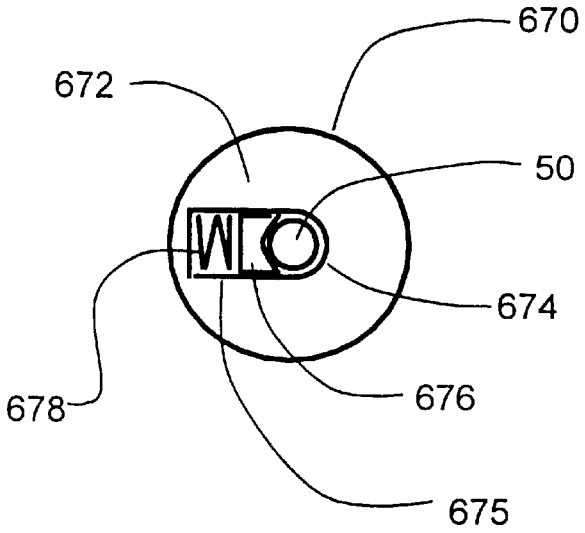
FIG. 9 is a top view of an alternative embodiment of the support leg of the adjustable firearm support of the present invention.

FIG. 9 is a top view of an alternative support leg 670 having a slotted bore 672. The slotted bore 672 has a threaded semi-cylindrical wall 674 at one end and a bias means 675 comprising a smooth bearing member 676 and spring 678 at the other end. Support rod 50 is urged by bias means 675 against threaded semi-cylindrical wall 674. When opposite manual pressure is applied to support leg 670, support rod 50 is released from threaded semi-cylindrical wall 674 so that support leg 670 can be freely moved relative to support rod 50. It should be readily apparent to the skilled reader that a spring biased insert could be disposed within a support leg having a smooth bore. The insert would have a slotted bore with one threaded wall. The insert could be manipulated by external manual pressure to release the threaded wall from a support rod so that the support leg could be easily translated relative to the support rod.

Figure 3:
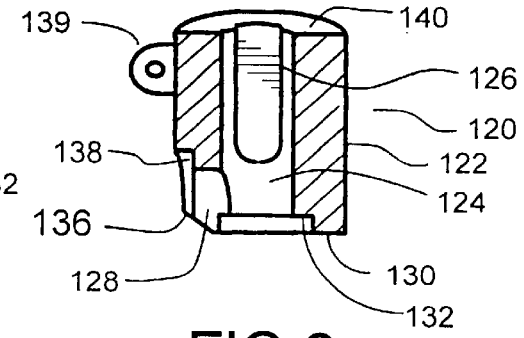
FIG. 3 is a section view taken from plane 3—3 of FIG. 2.
Figure 4:
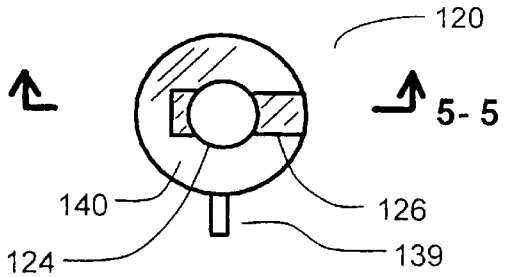
FIG. 4 is a top view taken from plane 4—4 of FIG. 2.
Figure 5:
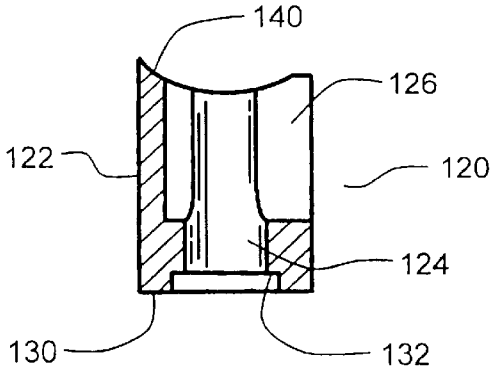
FIG. 5 is a section view taken form plane 5—5 of FIG. 4.

Base member 120 is shown in FIG. 2 and is shown in more detail in FIGS. 3, 4 and 5. FIG. 2 shows a front view of base member 120. As can be seen in FIG. 2, base member 120 has a cylindrical outer surface 122, a side slot 128, a clearance face 136, side spot face surface 138, a sling lug 139 and an upper cradle surface 140 and a lower surface 130. FIG. 3 is a section view of base member 120 taken from plane 3—3 of FIG. 2. FIG. 4 is a top view of base member 120 and FIG. 5 is a section view taken from plane 5—5 of FIG. 4. Together, these views show that base member 120 has a central bore 124, a clasp slot 126, and a lower spot face surface 132. Side spot face surface 138 is disposed in outer surface 122, while lower spot face surface 132 is defined within lower surface 130. As is best seen in FIG. 3, side slot 128 communicates with side spot face surface 138 clearance face 136 and lower spot face surface 132 and is adapted to allow support rod 50 to swing up into a retracted, horizontal position as it pivots about clevis pin 40. As is also shown in FIG. 3, central bore 124 runs the length of base member 120 from cradle surface 140 to lower spot face surface 132 and is sized to accept support rod 50 and sling stud 16. FIG. 5 shows that clasp slot 126 begins in cradle surface 140 and extends only part of the distance from cradle surface 140 to lower spot face surface 132 and is sized to allow clasp 20 to retract down into base member 120. As can be seen in FIG. 3 and FIG. 4, clasp slot 126 only extends across part of the width of base member 120. As is shown in FIG. 5, lower spot face surface 132 provides a recess for receiving shoulder portion 63 of position sleeve 60. Lower spot face surface 132 and side spot face surface 138 can define any axially symmetric surface definition as long as that definition corresponds to the axially symmetric upper surface defined by shoulder portion 63 of position sleeve 60. Sling lug 139 can either be recessed or projecting as shown in FIG. 3 and is adapted to receive a second clasp substantially identical to clasp 20 so that a sling strap can be attached to base member 120.

The skilled reader should easily appreciate that base member 120 could have a simple, flat lower surface while position sleeve 60 could have a corresponding, simple, flat upper surface. Such simple flat surfaces would fall within the general category of axially symmetric surfaces from which compatible surfaces could be selected. Likewise, base member 120 could also have a simple flat side surface disposed about side slot 128. Still further, while clearance face 136 is helpful to the operation of firearm support 10, it could be omitted because it is not necessary to the function of firearm support 10. It should also be readily apparent to the skilled reader that sling lug 139 could be moved to locations on outer surface 122 of base member 120 other than the location shown in FIGS. 2, 3, and 4.

The adjustable firearm support 10 can be assembled as follows: First, support rod 50 is threaded into support leg 70 so that bolt head 58 of support rod 50 is closely adjacent to top end of counter bore 75 of support leg 70. Second, rotation member 76 is glued into the bottom end of support leg 70. Third, position sleeve 60 is threaded down onto support rod 50 until it is closely adjacent to top surface 73 of support leg 70. Fourth, base member 120 is placed down upon support rod 50 until lug portion 52 of support rod 50 emerges above cradle surface 140 of base member 120. Fifth and finally, clasp 20 is attached to clevis portion 53 of support rod 50 by inserting clevis pin 40 through co-axial clevis pin holes 38 of clasp 20 and hole 53 of support rod 50.

The assembled adjustable firearm support 10 can be used with a firearm having firearm stock 14 and a sling stud 16 in the following manner: Clasp 20 is attached to sling stud 16 by disengaging latch plate 34 from clasp pin 26, inserting clasp pin 26 into sling stud hole 17 and then re-engaging latch plate 34 with clasp pin 26. Position sleeve 60 is rotated about support rod 50 until it pushes up against spot face surface 132 of base member 120 so that cradle surface 140 of base member 120 firmly engages firearm stock 14. Rotation member 76 of support leg 70 is then placed on a stable surface and support leg 70 is then rotated about support rod 50 to finely adjust the vertical position of firearm stock 14.

Figure 7:
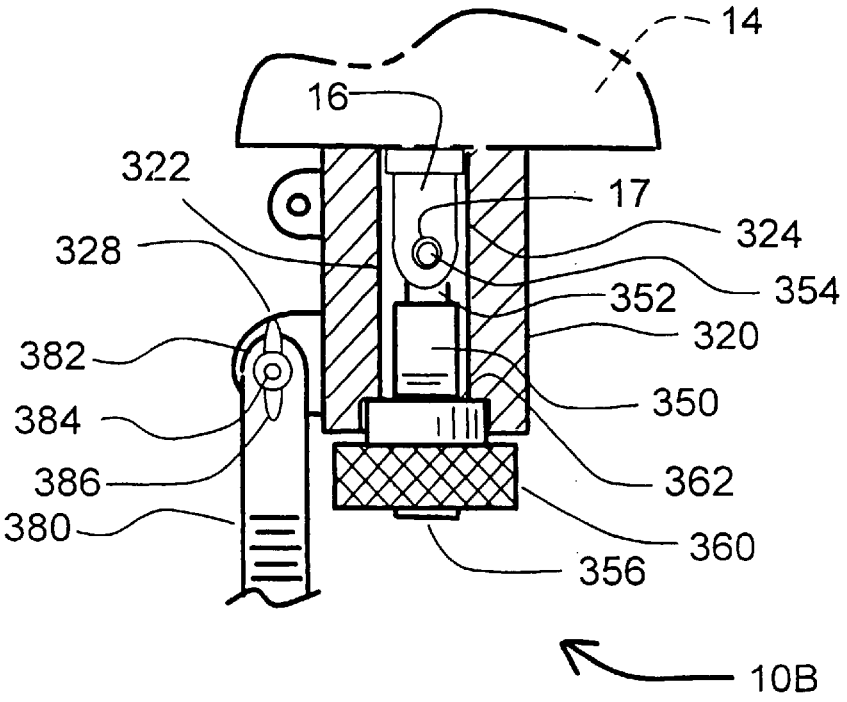
FIG. 7 is a side view of a second alternative embodiment of the adjustable firearm support of the present invention.
Figure 8:
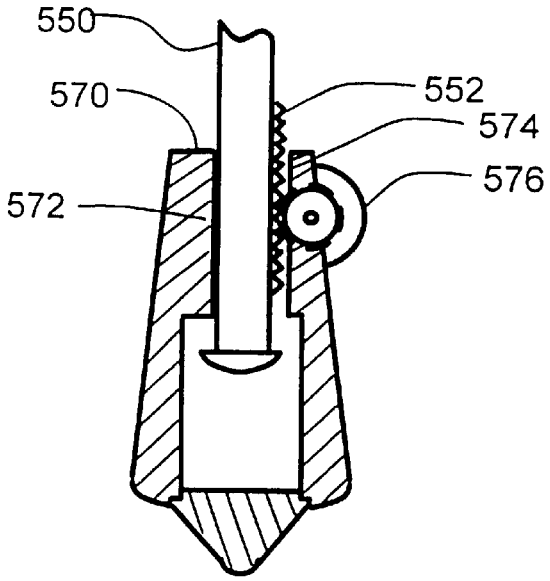
FIG. 8 is a cross section view of an alternative embodiment of the support leg of the adjustable firearm support of the present invention.

Shown in FIG. 8 is an alternate means for adjusting the vertical position of a support rod 550 in relation to a support leg 570. FIG. 7 shows a support rod 550 that is smooth and carries a rack 552. FIG. 7 also shows a leg 570 having a smooth bore 572 for receiving support rod 550, a slot 574 for clearing rack 552 and a rotatably mounted gear axle and knob assembly 576 adapted for engaging rack 552 thereby providing an alternative vertical adjustment means for adjusting the vertical position of support leg 570 in relation to support rod 550. Support rod 550 of FIG. 7 still includes a threaded upper portion (not shown) for receiving a position sleeve such as the position sleeve 60 shown in FIG. 2. The skilled reader will readily appreciate that any one of several different vertical adjustment means could be employed to accomplish the vertical adjustment of a support leg relative to a support rod and the remainder a firearm support.

The adjustable firearm support 10 of the present invention can be placed in a retracted position by loosening position sleeve 60 so that shoulder portion 63 of position sleeve 60 is disengaged from lower spot face 132. Support rod 50 together with position sleeve 60 and support leg 70 can be rotated about clevis pin 40 and through side slot 128 of base member 120 while shoulder portion 63 of position sleeve 60 just misses clearance face 136 of base member 120. After the support rod 50, position sleeve 60 and support leg 70 have been thus rotated from a vertical position to a horizontal position, position sleeve 60 can be tightened until shoulder portion 63 of position sleeve 60 firmly engages side spot face surface 138 of base member 120 thereby locking support rod 50, position sleeve 60 and support leg 70 into a folded position.

As is evident from the above description, clasp 20, support rod 50, position sleeve 60 and base member 120 cooperate with sling stud 16 to provide a clamping means for clamping the adjustable firearm support 10 to firearm stock 14. It will be evident to those skilled in the art that this preferred embodiment as well as other embodiments described herein could employ other means of clamping an adjustable firearm support to a firearm stock. Such other means could include a flexible strap that can be tightened to pull a base member or base member similar to base member 120 tightly against a firearm stock such as firearm stock 14. Such a strap could also include a leveraged buckle for tightly securing a base member or base member such as base member 120 to a firearm stock such as firearm stock 14. Such other means could include a threaded tap recessed into stock 14 in combination with a threaded bolt member for securing a base member similar to base member 120 to stock 14. Numerous other mechanical means could be imagined for securing a base member or base member such as base member 120 to stock 14. Once a base member such as base member 120 is firmly fixed to a firearm stock, a support leg in combination with a support rod attached to such a base member can be used to provide a means for vertical adjustment.

Figure 6:
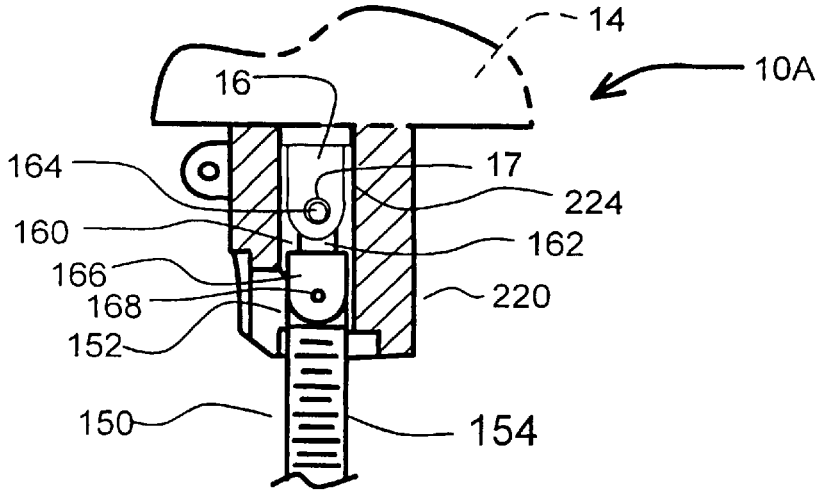
FIG. 6 is a side view of a first alternative embodiment of the adjustable firearm support of the present invention.

As shown in FIG. 6, a second embodiment of the adjustable firearm support 10A is shown in relation to firearm stock 14 and sling stud 16 having sling stud hole 17. Adjustable firearm support 10A includes a support rod 150, a hook member 160 and a modified base member 220. Support rod 150 includes an upper lug portion 152 a lower threaded portion 154. Hook member 160 includes a hook 162 having a horizontal pin 164 for engaging sling stud hole 17. Hook member 160 also has a clevis 166 for attaching to upper lug portion 152 of support rod 150. Clevis 166 of hook member 160 is pinned by joint pin 168 to a corresponding upper lug portion 152 of support rod 150. Once lower lug portion 152 of support rod 150 is pinned to clevis 166 of hook member 160, support rod 150 can rotate around the joint between clevis 166 and lug portion 152. The remainder of support rod 150 is substantially identical to support rod 50 described above. Modified base member 220 is identical to base member 120 of FIG. 2, except that it does not have a feature corresponding to clasp slot 126 of base member 120. Central bore 224 of base member 220 is also adapted to closely fit around support rod 150. A position sleeve (not shown) substantially identical to position sleeve 60 of FIG. 2 is employed as described above to bias base member 220 against the firearm stock. As described above, support rod 150 receives a support leg (not shown) which is substantially identical to support leg 70 shown in FIG. 2. In this embodiment, support rod 150 would have to made from a high strength material capable of withstanding significant stresses.

Illustrated in FIG. 7, is a third alternative embodiment of adjustable firearm support 10B of the present invention shown in relation to adjustable firearm stock 14 and sling stud 16 having sling stud hole 17. Adjustable adjustable firearm support 10B includes a base member 320, a first support rod 350, a position sleeve 360 and a second support rod 380. In this embodiment, first support rod 350 includes an upper portion 352 and a lower portion 356. Upper portion 352 of first support rod 350 has a stationary hook 354 adapted for engaging sling stud 16 and lower portion 356 of first support rod 350 is threaded to receive internally threaded position sleeve 360. Base member 320 has a lower spot face surface 324 for receiving position sleeve 360. Base member 320 also has a central bore 322 for receiving sling stud 16 and support rod 350. Position sleeve 360 threads onto first support rod 350 and has an axially symmetric upper surface 362 adapted for smoothly engaging lower spot face surface 324 of base member 320. Base member 320 also has a means for attaching second support rod 380. Second support rod 380 can be rigidly fixed to base member

320 or can be pivotably mounted to base member 320. FIG. 4 shows second support rod 380 having an upper clevis portion 382 that engages a lug 328 fixed to base member 320. A bolt 384 and a wing nut 386 clamp upper clevis portion 382 of second support rod 380 to lug 328 of base member 320. With the addition of a locking means such as corresponding serrated surfaces (not shown) or a lock washer (not shown), the joint between upper clevis portion 382 of second support rod 380 and lug 328 of base member 320 can be locked in either a vertical or retracted horizontal position. As with the above described embodiments, second support rod 380 receives a support leg (not shown) which is substantially identical to support leg 70 shown in FIG. 2. and that support leg can be rotated about second support rod 380 to provide fine vertical adjustment.

The skilled reader, in view of this specification may envision numerous modifications and variations of the above disclosed preferred embodiment.

Accordingly, the reader should understand that these modifications and variations, and the equivalents thereof, are within the spirit and scope of this invention as defined by this specification and by the following claims wherein, I claim:

1. In combination with a firearm including a firearm stock, the firearm stock having a bottom mounted sling stud, an adjustable firearm support for adjusting the vertical position of the firearm stock in relation to a stable horizontal surface comprising;

a support rod, a position sleeve, a base member, a support leg and a vertical adjustment means, the support rod having an externally threaded surface, the support rod also having a clasp at its upper end adapted for pivotably engaging the sling stud, the base member having an upper cradle surface adapted to fit up against the bottom surface of the firearm stock, a lower surface, a side wall and a central opening extending from the upper cradle surface to the surface for receiving the support rod, the position sleeve having a threaded central bore for receiving the externally threaded surface of the support rod, the position sleeve also having an upper surface adapted to fit up against lower surface of the base member, the support leg having at its upper end, an opening ADAPTED for receiving AND HOLDING the support rod, the support leg also having a lower end adapted to stand on the stable, horizontal surface, the adjustment means for adjusting the position of the support rod in relation to the support leg, the support rod attached to the sling stud, the base member receiving the support rod and fitted up against the firearm stock, the position sleeve threaded about the support rod so that its upper surface engages the lower surface of the base member, the position sleeve tightened up against the base member thereby clamping the base member and the support rod to the firearm stock, the support leg receiving the support rod, the lower end of the support leg placed upon the stable, horizontal surface, the adjustment means operated to adjust the position of the support leg in relation to the support rod thereby precisely adjusting the vertical position of the firearm stock in relation to the stable, horizontal surface.

2. The adjustable firearm support of claim 1, wherein the vertical adjustment means comprises a rack disposed on the support rod and a gear rotatably mounted on the support leg, whereby the gear on the support leg engages the rack disposed on the support rod so that by rotating the gear the position of the support rod in relation to the support rod can be finely adjusted.

3. The adjustable firearm support of claim 1, wherein the vertical adjustment means comprises a continuous thread disposed on the outer surface of the support rod and a corresponding continuous thread disposed in the opening in the upper end of the support leg, whereby the support leg can be rotated about the support rod to finely adjust the position of the support leg in relation to the support rod.

4. In combination with a firearm including a firearm stock, the firearm stock having a bottom mounted sling stud, an adjustable firearm support for adjusting the vertical position of the firearm stock in relation to a stable horizontal surface comprising;

a support rod, a position sleeve, a base member, a support leg and a vertical adjustment means, the support rod having an externally threaded surface, the support rod also having a clasp at its upper end adapted for pivotably engaging the sling stud, the base member having an upper cradle surface adapted to fit up against the bottom surface of the firearm stock, a lower surface, a side wall, a central opening extending from the upper cradle surface to the surface for receiving the support rod and a side slot extending from the side wall of the base member to the central opening of the base member and down to the lower surface of the base member, the position sleeve having a threaded central bore for receiving the externally threaded surface of the support rod, the position sleeve also having an upper surface adapted to fit up against lower surface of the base member, the support leg having at its upper end an opening ADAPTED for receiving AND HOLDING the support rod, the support leg also having a lower end adapted to stand on the stable, horizontal surface, the adjustment means for adjusting the position of the support rod in relation to the support leg, the support rod attached to the sling stud, the base member receiving the support rod and fitted up against the firearm stock, the position sleeve threaded about the support rod so that its upper surface engages the lower surface of the base member, the position sleeve tightened up against the base member thereby clamping the base member and the support rod to the firearm stock, the support leg receiving the support rod, the lower end of the support leg placed upon the stable, horizontal surface, the adjustment means operated to adjust the position of the support leg in relation to the support rod thereby precisely adjusting the vertical position of the firearm stock in relation to the stable, horizontal surface, the position sleeve threaded about the support rod so that its upper surface disengages the lower surface of the base member, the support rod pivoted in relation to the sling stud, the support rod, position sleeve and support leg rotated up into a retracted position as the support rod swings through the side slot of the base member, the position sleeve tightened to engage the side wall of the base member, whereby the support rod, position sleeve and support leg are secured in a folded, retracted position.

5. The adjustable firearm support of claim 4, wherein the vertical adjustment means comprises a rack disposed on the support rod and a gear rotatably mounted on the support leg, whereby the gear on the support leg engages the rack disposed on the support rod so that by rotating the gear the position of the support rod in relation to the support rod can be finely adjusted.

6. The adjustable firearm support of claim 4, wherein the vertical adjustment means comprises a continuous thread disposed on the outer surface of the support rod and a corresponding continuous thread disposed in the opening in the upper end of the support leg, whereby the support leg can be rotated about the support rod to finely adjust the position of the support leg in relation to the support rod.

7. The adjustable firearm support of claim 4, wherein the clasp at the upper end of the support rod is pivotably mounted to the support rod to provide a second pivot joint whereby the support rod rotates about the second pivot joint between the clasp and the support rod when the support rod, position sleeve and support leg are rotated up into a retracted position.

8. The adjustable firearm support of claim 4, wherein the upper surface of the position sleeve, the lower surface of the base member and the side wall of the base member around the side slot are all substantially flat so that the position sleeve may engage the lower surface of the base member and the side wall of the base member around the side slot more easily.

9. The adjustable firearm support of claim 4, wherein the upper surface of the position sleeve, the lower surface of the base member and the side wall of the base member around the side slot are all axially symmetric so that the position sleeve may engage the lower surface of the base member and the side wall of the base member around the side slot more easily.

10. The adjustable firearm support of claim 4, wherein the vertical adjustment means comprises a continuous thread disposed on the outer surface of the support rod and a corresponding continuous thread disposed in the opening in the upper end of the support leg, whereby the support leg can be rotated about the support rod to finely adjust the position of the support leg in relation to the support rod, wherein the support leg further comprises a counter bore and a rotation member, the counter bore of substantially larger diameter of the threaded bore of said support leg, the counter bore in co-axial relation to the threaded bore, the counter bore extending from the bottom end of the support leg, the rotation member having a lower end adapted for axial rotation on a stable surface, the rotation member adapted to fit into the lower end of the counter bore, and wherein the support rod further comprises a bolt head disposed at its lower end opposite the removable clasp at its upper end, the support rod threaded into the support leg, the bolt head of the support rod enclosed within a cavity defined by counter bore and the rotation member, whereby the range of motion of the support rod in relation to the support leg is limited to the range of motion of the bolt head within the cavity.

11. The adjustable firearm support of claim 4, wherein, the vertical adjustment means comprises a continuous thread disposed on the outer surface of the support rod and a corresponding continuous thread disposed in the opening in the upper end of the support leg, whereby the support leg can be rotated about the support rod to finely adjust the position of the support leg in relation to the support rod, and wherein the support leg threaded bore further comprises at least one slotted portion having a substantially smooth walls and a threaded portion at one end thereof, the support leg also having spring biasing means for urging the support rod into contact with the threaded portion, the spring biasing means also adapted to yield to a manual pressure, the spring biasing means opposed by the manual pressure, the support rod translated relative to the support leg until it disengages the threaded wall whereby the support leg may be moved freely in relation to the support rod for rapid vertical adjustment.

12. An adjustable firearm support for a firearm having a sling stud with a central bore, the firearm support comprising;

a first support rod, a second support rod, a position sleeve, a base member, a support leg and a vertical adjustment means, the first support rod having an externally threaded surface, the first support rod also having a clasp at its upper end adapted for pivotably engaging the sling stud, the second support rod also having an externally threaded surface, the second support rod adapted to attach to the base member, the base member having an upper cradle surface adapted to fit up against the bottom surface of the firearm stock, a lower surface, a side wall and a central opening extending from the upper cradle surface to the surface for receiving the support, the base member also adapted to engage the second support rod, the position sleeve having a threaded central bore for receiving the externally threaded surface of the first support rod, the position sleeve also having an upper surface adapted to fit up against lower surface of the base member, the support leg having at its upper end an opening for receiving the second support rod, the support leg also having a lower end adapted to stand on the stable, horizontal surface, the adjustment means for adjusting the position of the second support rod in relation to the support leg, the first support rod attached to the sling stud, the base member receiving the first support rod and fitted up against the firearm stock, the position sleeve threaded about the first support rod so that its upper surface engages the lower surface of the base member, the position sleeve tightened up against the base member thereby clamping the base member and the support rod to the firearm stock, the second support rod attached to the base member, the support leg receiving the second support rod, the lower end of the support leg placed upon the stable, horizontal surface, the adjustment means operated to adjust the position of the support leg in relation to the second support rod thereby precisely adjusting the vertical position of the firearm stock in relation to the stable, horizontal surface.

13. The adjustable firearm support of claim 12, wherein the vertical adjustment means comprises a rack disposed on the second support rod and a gear rotatably mounted on the support leg, whereby the gear on the support leg engages the rack disposed on the second support rod so that by rotating the gear the position of the support rod in relation to the support rod can be finely adjusted.

14. The adjustable firearm support of claim 12, wherein the vertical adjustment means comprises a continuous thread disposed on the outer surface of the second support rod and a corresponding continuous thread disposed in the opening in the upper end of the support leg, whereby the support leg can be rotated about the second support rod to finely adjust the position of the support leg in relation to the second support rod.

* * * * *